US010139783B2

(12) United States Patent
Matsuzawa et al.

(10) Patent No.: US 10,139,783 B2
(45) Date of Patent: Nov. 27, 2018

(54) HAND DEVICE, ELECTRONIC TIMEPIECE, HAND DRIVING METHOD OF ELECTRONIC TIMEPIECE AND RECORDING MEDIUM

(71) Applicant: CASIO COMPUTER CO., LTD., Shibuya-ku, Tokyo (JP)

(72) Inventors: Koichi Matsuzawa, Ome (JP); Takaomi Yonekura, Akiruno (JP); Iichiro Hashimoto, Kawasaki (JP); Keishirou Yamamoto, Kokubunji (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/412,832

(22) Filed: Jan. 23, 2017

(65) Prior Publication Data

US 2017/0261934 A1 Sep. 14, 2017

(30) Foreign Application Priority Data

Mar. 10, 2016 (JP) ..... 2016-046432

(51) Int. Cl.
*G04C 17/00* (2006.01)
*G04B 19/04* (2006.01)

(52) U.S. Cl.
CPC ..... *G04B 19/04* (2013.01); *G04C 17/00* (2013.01); *G04C 17/0091* (2013.01)

(58) Field of Classification Search
CPC ..... G04B 19/04; G04B 19/06; G04B 19/082; G04C 17/00; G04F 7/00; G04F 7/08; G04F 8/00; G04F 10/00; G04F 7/06; G04F 3/022; G04F 3/00; G04F 1/00; G04G 11/00
See application file for complete search history.

(56) References Cited

U.S. PATENT DOCUMENTS

| | | | | |
|---|---|---|---|---|
| 5,077,708 | A | 12/1991 | Schneider | |
| 5,440,527 | A | 8/1995 | Okamoto | |
| 5,959,941 | A * | 9/1999 | Murakami | G04F 8/00 368/110 |
| 7,596,057 | B2 * | 9/2009 | Linder | G04C 3/146 368/228 |
| 2004/0047242 | A1 * | 3/2004 | Germiquet | G01D 7/002 368/11 |

(Continued)

FOREIGN PATENT DOCUMENTS

| | | | |
|---|---|---|---|
| JP | 55160887 | A | 12/1980 |
| JP | 03051790 | A | 3/1991 |

(Continued)

OTHER PUBLICATIONS

Japanese Office Action (and English language translation thereof) dated Aug. 21, 2018 issued in counterpart Japanese Application No. 2016-046432.

*Primary Examiner* — Sean Kayes
(74) *Attorney, Agent, or Firm* — Holtz, Holtz & Volek PC

(57) ABSTRACT

A hand device includes a hand configured to reciprocally move in a fan shape at an equal speed in a counterclockwise direction and in a clockwise direction, a driving unit configured to drive the hand, and a display unit, at least a part of which is arranged below the hand and within a reciprocal movement range of the hand, the display unit being configured to display predetermined information by a combination of a blinking and a position of the hand.

20 Claims, 11 Drawing Sheets

(56) References Cited

U.S. PATENT DOCUMENTS

| | | | | |
|---|---|---|---|---|
| 2007/0047392 | A1* | 3/2007 | Parkinson | G04F 1/005 368/108 |
| 2007/0153633 | A1* | 7/2007 | Plancon | G04B 19/082 368/11 |
| 2007/0183264 | A1* | 8/2007 | Raeber | B63C 11/32 368/11 |
| 2009/0209896 | A1* | 8/2009 | Selevan | A61B 5/01 602/41 |
| 2011/0069589 | A1* | 3/2011 | Plancon | G04B 19/082 368/11 |
| 2016/0266548 | A1* | 9/2016 | Akiyama | G04B 27/002 |
| 2017/0212476 | A1* | 7/2017 | Iijima | G04B 47/066 |

FOREIGN PATENT DOCUMENTS

| | | | |
|---|---|---|---|
| JP | 07146384 | A | 6/1995 |
| JP | 2000310690 | A | 11/2000 |
| JP | 2005315669 | A | 11/2005 |
| JP | 2013029400 | A | 2/2013 |

* cited by examiner

HAND DEVICE, ELECTRONIC TIMEPIECE, HAND DRIVING METHOD OF ELECTRONIC TIMEPIECE AND RECORDING MEDIUM

CROSS-REFERENCE TO RELATED APPLICATION

This application is based upon and claims the benefit of priority from the prior Japanese Patent Application No. 2016-46432 filed on Mar. 10, 2016, and the entire contents of which are incorporated herein by reference.

BACKGROUND OF THE INVENTION

The disclosure relates to a hand device having a retrograde hand, an electronic timepiece, a hand driving method of the electronic timepiece and a recording medium.

The retrograde is a French astronomical terminology indicative of the antecedence. In a timepiece, the retrograde means a mechanism configured to display time, a calendar and the like by a hand configured to repetitively move. Herein, an example of a day display in which seven days are set as one period is described. A day hand of the retrograde moves from Monday, which is a starting point, to Sunday, which is an ending point, via Tuesday, Wednesday, Thursday, Friday and Saturday by one day. Also, when switching from Sunday to next Monday, the day hand switches to the starting point in a moment. Thereby, the entertainment characteristic is secured by the movement of the hand, which is pleasure to user's eyes.

For example, an Abstract of a Japanese Patent Application Publication No. 2005-315669A discloses "A day display area is made into a fan-shaped display of a retrograde tone, a year display area and an alarm setting state check area are arranged in a surplus area thereof, and the corresponding information is displayed by a day hand 7. A display content of the day hand 7 can be arbitrarily changed by an external operation in a current time display mode. Thereby, it is possible to display the information as much as possible in a limited display area, to check the information on the current time display mode without changing a mode to call a predetermined mode, and to simplify the operation specifications."

According to the invention disclosed in Patent Document 1, it is possible to display a plurality of operation functions by the retrograde. However, according to this configuration, the current operation mode is simply displayed and the user cannot easily understand an operation state of a device such as a function shift operation and the like by the movement of the hand.

Also, the retrograde disclosed in Patent Document 1 is implemented by providing an area in which it can rotate over one week and using a fan-shaped area of a part thereof. Thereby, even though the hand is not rotatively driven in both clockwise and counterclockwise directions, the hand is rotatively driven only in one direction, so that the retrograde can be implemented. However, as compared to the retrograde configured to reciprocally move the hand in the fan-shaped area, the display area is smaller, so that the visibility is lower.

Also, there is a retrograde configured to gradually accumulate the repulsive energy in an elastic body such as a spring, a windup spring or the like as the hand moves, and to switch the hand to the starting point by using the repulsive energy at the ending point. According to this mechanism, it is possible to move the hand to the fan-shaped area. However, since the energy is accumulated in the elastic body, the movement of the hand is limited to only one direction.

SUMMARY OF THE INVENTION

It is therefore an object of the invention to display a variety of information in a fan-shaped area by a retrograde hand capable of reciprocally moving at an equal speed in a counterclockwise direction and in a clockwise direction, in a hand device, an electronic timepiece, a hand driving method of the electronic timepiece and a recording medium.

A hand device according to the invention comprises:

a hand configured to reciprocally move in a fan shape at an equal speed in a counterclockwise direction and in a clockwise direction;

a driving unit configured to drive the hand; and a display unit, at least a part of which is arranged below the hand and within a reciprocal movement range of the hand, the display unit being configured to display predetermined information by a combination of a blinking and a position of the hand.

DETAILED DESCRIPTION

Hereinafter, an exemplary embodiment of the invention will be described in detail with reference to the drawings.

Figure 1:
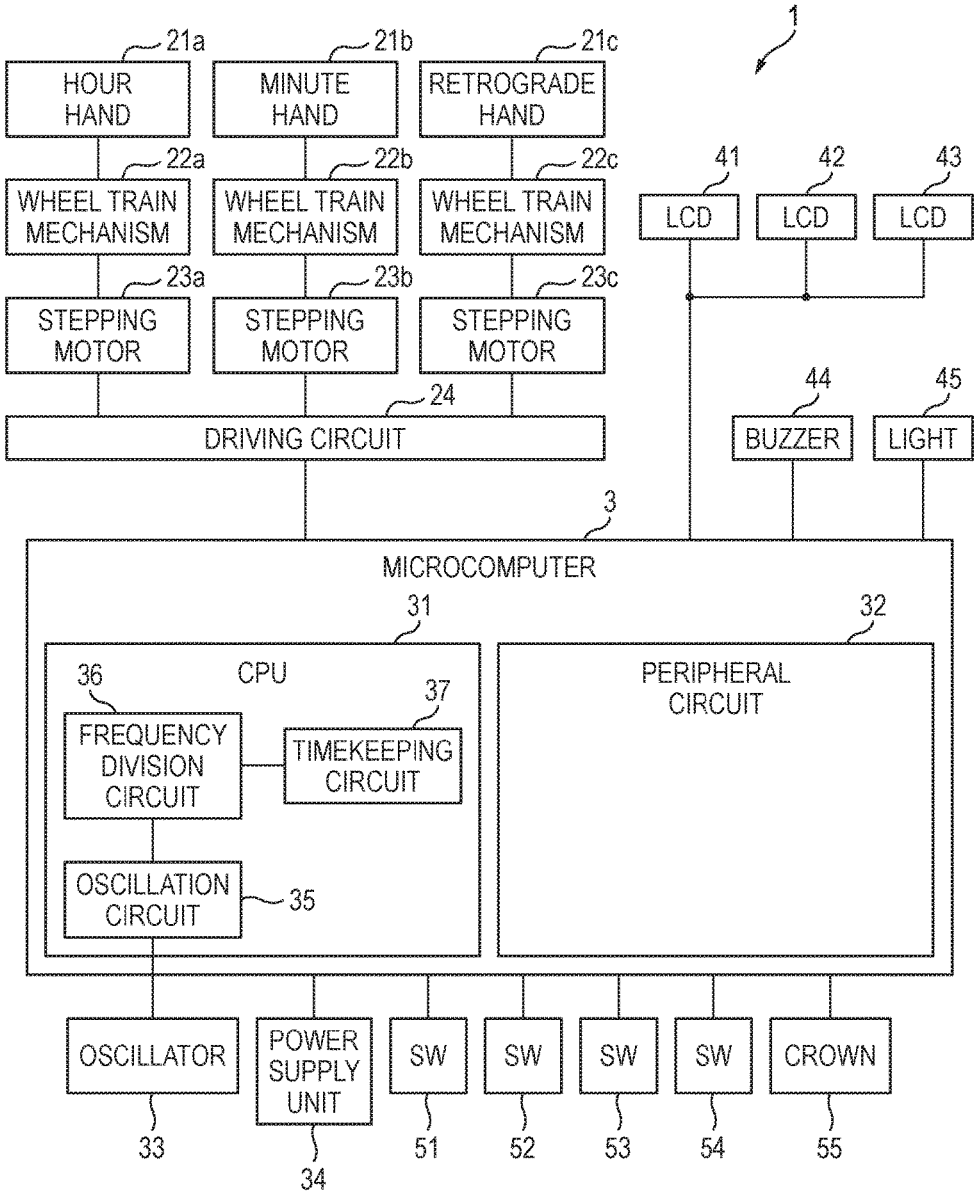
FIG. 1 is a schematic configuration view depicting an electronic timepiece of an exemplary embodiment.

FIG. 1 is a schematic configuration view depicting an electronic timepiece 1 of the exemplary embodiment.

The electronic timepiece 1 of the exemplary embodiment is configured to respectively drive an hour hand 21*a*, a minute hand 21*b* and a retrograde hand 21*c* by independent motors and is not particularly limited. However, for example, a wristwatch-type electronic timepiece having a band for mount on an arm may be exemplified. The electronic timepiece 1 has the hour hand 21*a*, the minute hand 21*b*, the retrograde hand 21*c*, stepping motors 23*a* to 23*c* configured to rotatively drive the hands via wheel train mechanisms 22*a* to 22*c*, a driving circuit 24, and a microcomputer 3, for example. The electronic timepiece 1 further has a power supply unit 34, an oscillator 33, LCDs (Liquid Crystal Displays) 41 to 43, a buzzer 44, a light 45, switches 51 to 54 and a crown 55. Meanwhile, in FIG. 1, the switches 51 to 54 are simply referred to as "SW".

In the below, when it is not necessary to particularly distinguish the wheel train mechanisms 22*a* to 22*c*, they are simply referred to as the wheel train mechanism 22. When it is not necessary to particularly distinguish the stepping motors 23*a* to 23*c*, they are simply referred to as the stepping motor 23.

The driving circuit 24 is a bridge circuit configured to drive the stepping motor 23, and configures a motor driving device by a combination with the microcomputer 3. The microcomputer 3 is a large-scale integration (LSI) circuit and includes a CPU (Central Processing Unit) 31, a peripheral circuit 32, an oscillation circuit 35, a frequency division circuit 36 and a timekeeping circuit 37.

Each of the stepping motors 23*a* to 23*c* is a high-torque motor having a plurality of coils, for example. The stepping motors 23*a* to 23*c* are configured to drive the hour hand 21*a*, the minute hand 21*b* and the retrograde hand 21*c* via the wheel train mechanisms 22*a* to 22*c*, thereby enabling the hands to indicate predetermined directions. A combination of the wheel train mechanism 22*c*, the stepping motor 23*c*, the driving circuit 24 and the microcomputer 3 configures the driving unit configured to drive the retrograde hand 21*c*.

Figure 2A:
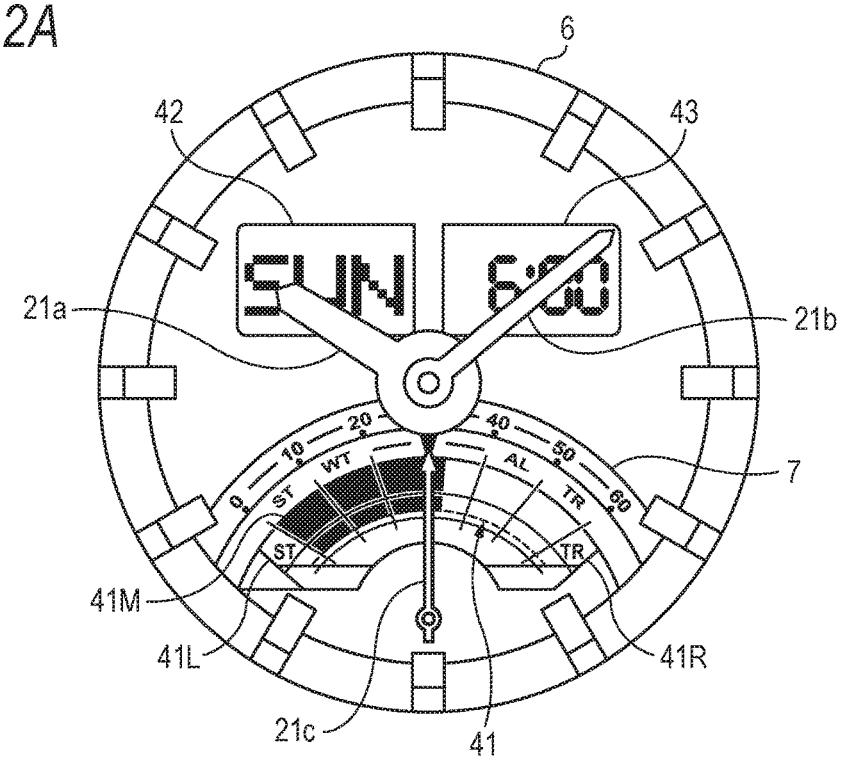
FIGS. 2A and 2B depict shift to a timer mode.

The hour hand 21*a* and the minute hand 21*b* are provided to be rotatable at a central rotary shaft of a main dial plate 6 (refer to FIG. 2A). The retrograde hand 21*c* is configured to reciprocally move over a range of about 120° about a rotary shaft thereof. Since the stepping motor 23*c* has high torque performance, it can reciprocally move the retrograde hand 21*c* in a fan shape at an equal speed in a counterclockwise direction and in a clockwise direction.

The driving circuit 24 is configured to output driving voltage signals for driving the stepping motors 23*a* to 23*c* at an appropriate timing, based on a control signal input from the microcomputer 3. The driving circuit 24 can adjust and output a driving voltage and a driving voltage pulse width of the stepping motor 23, based on a setting signal from the microcomputer 3. The driving circuit 24 can output the driving voltage signal to the stepping motor 23 in a forward rotation direction or a reverse rotation direction.

The CPU 31 is configured to perform a variety of calculation processing and to collectively control an entire operation of the electronic timepiece 1. The CPU 31 is configured to read and execute a control program, to enable the respective units to continuously perform operations relating to the time display, and to perform a requested operation in real time or at a set timing on the basis of an input operation through the switches 51 to 54 and the crown 55, which are the operation unit. The switches 51 to 54 and the crown 55 are configured to function as the reception unit for receiving an operation mode, and the CPU 31 is configured to drive the retrograde hand 21*c* to a position indicating the corresponding operation mode by the wheel train mechanism 22*c*, the stepping motor 23*c* and the driving circuit 24.

The CPU 31 is a control unit configured to set target positions to which the hour hand 21*a*, the minute hand 21*b* and the retrograde hand 21*c* are to move and to control the driving of the stepping motor 23 via the driving circuit 24. The CPU 31 is further configured to display a variety of information on the LCDs 41 to 43, which are the display unit, and to notify a user of a variety of information by the buzzer 44 and the light 45, which are the notification unit.

The oscillation circuit 35 is configured to generate an inherent frequency signal and to output the same to the frequency division circuit 36. As the oscillation circuit 35, a circuit configured to oscillate in combination with the oscillator 33 such as crystal is used, for example.

The frequency division circuit 36 is configured to divide and output the signal input from the oscillation circuit 35 into signals of diverse frequencies, which are to be used by the CPU 31 and the timekeeping circuit 37.

The timekeeping circuit 37 is a counter circuit configured to count the signals of predetermined frequencies input from the frequency division circuit 36, to add the same to initial time and to count current time. The current time to be counted by the timekeeping circuit 37 is read out by the CPU 31 and is used for time display. The counting of the time may be controlled in a software manner.

The power supply unit 34 is configured so that the electronic timepiece 1 can operate continuously and stably for a long time, and is a combination of a battery and a DC-DC converter, for example. Thereby, an output voltage of the power supply unit 34 under operation is kept at a predetermined value.

Operations in Timer Mode

A timer mode is a mode in which remaining time of preset time is displayed (countdown) and elapse of the set time is notified when the remaining time becomes 0 minute, 0 second. Time information that is to be displayed in the timer mode is herein referred to as remaining time of the timer. The remaining time of the timer is displayed by a combination of second information (first time information) and minute information (second time information), which is a set of the second information.

Figure 2B:
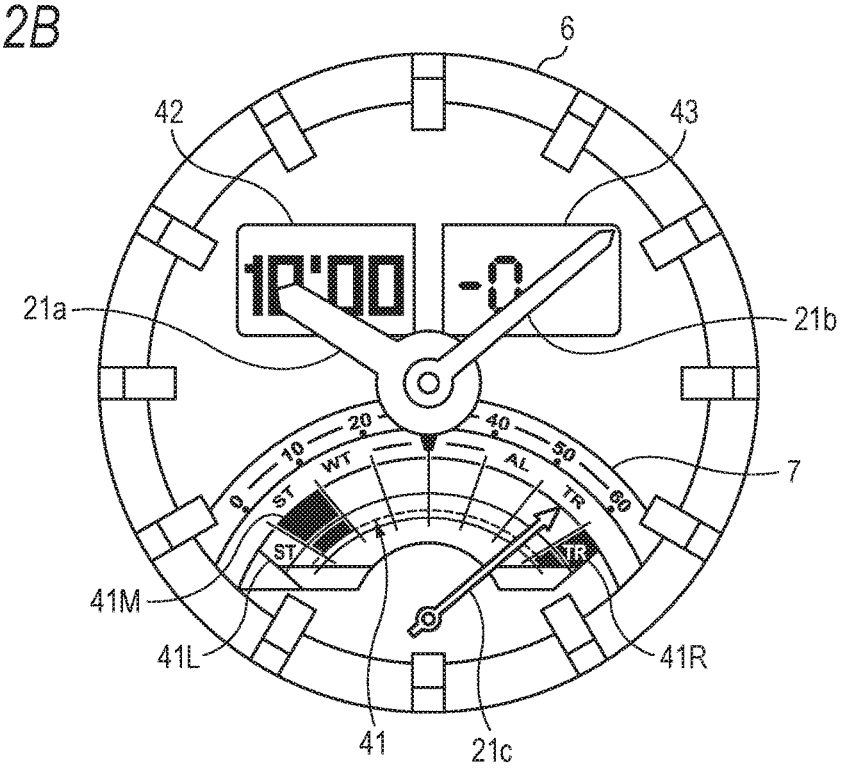

FIGS. 2A and 2B depict shift of the electronic timepiece 1 to the timer mode.

FIG. 2A is an outline view of the electronic timepiece 1 in a basic timepiece mode.

The electronic timepiece 1 has a disc-shaped main dial plate 6 and a fan-shaped sub-dial plate 7 provided at a lower part of the main dial plate 6. At a center of the main dial plate 6, a rotary shaft of the hour hand 21*a* and the minute hand 21*b* is provided. A rotary shaft of the retrograde hand 21*c* is provided at a lower part of the fan-shaped sub-dial plate 7. On the sub-dial plate 7, numbers from zero (0) to 60 are inscribed in order from left, which indicate meanings to be displayed by the retrograde hand 21*c* and the LCD 41. In the sub-dial plate 7, the inscription "0" is inscribed at a position inclined leftward by 60°, the inscription "10" is inscribed at a position inclined leftward by 40°, the inscription "20" is inscribed at a position inclined leftward by 20°, the inscription "40" is inscribed at a position inclined rightward by 20°, the inscription "50" is inscribed at a position inclined rightward by 40°, and the inscription "60" is inscribed at a position inclined rightward by 60°.

On the sub-dial plate 7, letters of ST", "WT", "AL" and "TR" are further inscribed in order from left. The letter "ST" indicates a stop watch mode, the letter "WT" indicates a world time mode, the letter "AL" indicates an alarm mode, and the letter "TR" indicates a timer mode. Herein, the world time indicates a function by which times of main world cities, which are a second time zone except for a current location, can be known. The world time mode is a mode in which main world cities are to be set and times of the main cities are to be displayed.

The LCD 41 is arranged below the retrograde hand 21*c* and within a reciprocal movement range of the retrograde hand 21*c*. It is possible to display the remaining time of the timer and the elapse time of the stop watch by combining blinking of the LCD 41 and the position of the retrograde hand 21*c*. The LCD 41 has an ST display element 41L configured to display the letter "ST", a minute display element 41M configured to turn on/turn off respective elements of 0 minute to 60 minutes, and a TR display element 41R configured to display the letter "TR". The respective elements of 0 minute to 60 minutes, which configure the minute display element 41M, are configured as a radial shape every two degrees, and is arranged in a fan shape as a whole. In the meantime, the lighting of the LCD 41 indicates that black is to be displayed. The LCD 41 is configured to display the remaining time of the timer, the elapse time of the stop watch and the like by a combination of the blinking and the position indicated by the retrograde hand 21*c*.

The LCD 42 is arranged at an upper-left side of the main dial plate 6. The LCD 43 is arranged at an upper-right side of the main dial plate 6.

In the basic timepiece mode, the retrograde hand 21*c* indicates the upper side in FIG. 2A, and the ST display element 41L and the TR display element 41R are turned off. The LCD 42 displays a current day in English such as "SUN", for example. The LCD 43 indicates that the present is June 30, such as "6-30", for example.

FIG. 2B is an outline view of the electronic timepiece 1 when it shifts to the timer mode.

Figure 3A:
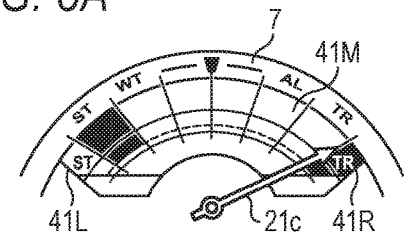
FIGS. 3A to 3I illustrate operations in the timer mode.

When the user pushes the switch 53 in the basic timepiece mode, the electronic timepiece 1 shifts to the timer mode. When the electronic timepiece shifts to the timer mode, the retrograde hand 21*c* indicates the letter "TR" for a predetermined time, so that a display shown in FIG. 3A is made, which will be described later. At this time, when the light 45 is turned on, the retrograde hand 21*c* indicates the letter "TR" until afterglow of the light 45 is over.

The LCD 41 turns on the minute display element 41M for a timer-set minute (herein, 10 minutes), and also turns on the TR display element 41R, thereby indicating the shift to the timer mode. The LCD 42 displays a minute and a second of the remaining time of the timer by integers, and the LCD 43 displays the number of decimal places of the second of the remaining time of the timer by a number.

FIGS. 3A to 3I illustrate operations in the timer mode. In the timer mode, the TR display element 41R at the right end of the LCD 41 is turned on to indicate the letter "TR", and the ST display element 41L is turned off.

FIG. 3A depicts the sub-dial plate 7 at a starting time point 10 minutes, 0.0 second of the countdown.

At this time, the retrograde hand 21*c* indicates a position "60" of the sub-dial plate 7. The minute display element 41M turns on the elements of 0 minute to 9 minutes, and turns off the elements of 10 minutes to 60 minutes. In this way, when the CPU 31 does the countdown from n minute, 0.0 second (n: natural number), it controls so that the retrograde hand 21*c* indicates the position "60". Thereby, it is possible to suppress the flyback at the starting time point of the countdown.

Figure 3B:
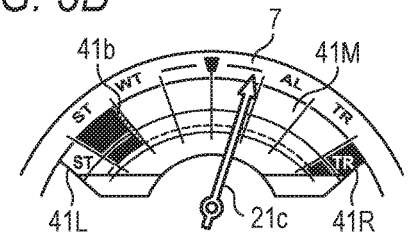

FIG. 3B depicts the sub-dial plate 7 at a time point at which the remaining time is counted down to 9 minutes, 37.6 seconds.

At this time, the retrograde hand 21*c* indicates a position "38" of the sub-dial plate 7. The minute display element 41M turns on the elements of 0 minute to 8 minutes, blinks the element of 9 minutes, and turns off the elements of 10 minutes to 60 minutes. In FIG. 3B, the element of 9 minutes being blinked is shown as a display element 41*b*. A blinking period is a few Hz. By the blinking of the display element 41*b*, it is possible to indicate that the timer is operating. Herein, when the user performs a stop operation, the electronic timepiece shifts to a state shown in FIG. 3C.

Figure 3C:
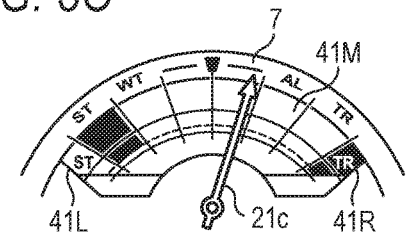

FIG. 3C depicts the sub-dial plate 7 at a time point at which the remaining time is counted down to 9 minutes, 37.6 seconds and the countdown has stopped.

At this time, the retrograde hand 21*c* indicates the position "38" of the sub-dial plate 7. The minute display element 41M turns on the elements of 0 minute to 8 minutes, and turns off the elements of 9 minutes to 60 minutes. Herein, when the user performs a start operation, the electronic timepiece shifts to the state shown in FIG. 3B.

Figure 3D:
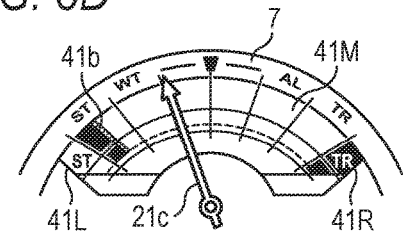

FIG. 3D depicts the sub-dial plate 7 at a time point at which the remaining time is counted down to 3 minutes, 21.4 seconds as the time elapses from FIG. 3B.

At this time, the retrograde hand 21*c* indicates a position "21.5" of the sub-dial plate 7. The minute display element 41M turns on the elements of 0 minute to 3 minutes, blinks the element of 4 minutes, and turns off the elements of 5 minutes to 60 minutes. In FIG. 3D, the element of 4 minutes being blinked is shown as the display element 41*b*. A blinking period is a few Hz. By the blinking of the display element 41*b*, it is possible to indicate that the timer is operating. Herein, when the user performs the stop operation, the electronic timepiece shifts to a state shown in FIG. 3E.

Figure 3E:
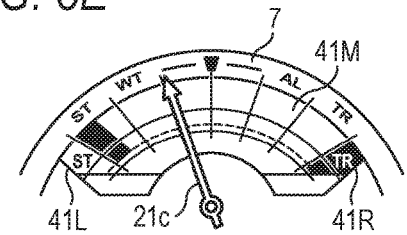

FIG. 3E depicts the sub-dial plate 7 at a time point at which the remaining time is counted down to 3 minutes, 21.4 seconds and the countdown has stopped.

At this time, the retrograde hand 21*c* indicates the position "21.5" of the sub-dial plate 7. The minute display element 41M turns on the elements of 0 minute to 3 minutes, and turns off the elements of 4 minutes to 60 minutes. Herein, when the user performs the start operation, the electronic timepiece shifts to the state shown in FIG. 3D.

Figure 3F:
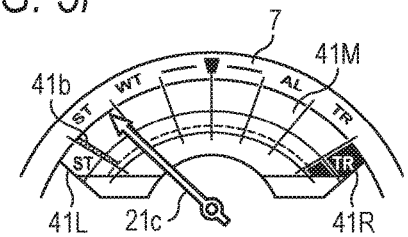

FIG. 3F depicts the sub-dial plate 7 at a time point at which the remaining time is counted down to 0 minute, 8.7 seconds as the time elapses from FIG. 3B.

At this time, the retrograde hand 21*c* indicates a position "9" of the sub-dial plate 7. The minute display element 41M blinks the element of 0 minute, and turns off the elements of 4 minutes to 60 minutes. In FIG. 3F, the element of 0 minute being blinked is shown as the display element 41*b*. A blinking period is a few Hz. By the blinking of the display element 41*b*, it is possible to indicate that the timer is operating. Herein, when the user performs the stop operation, the electronic timepiece shifts to a state shown in FIG. 3G.

Figure 3G:
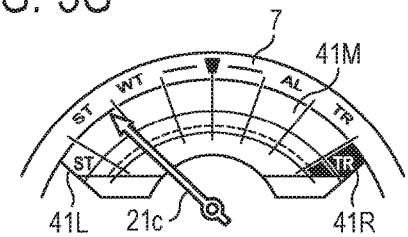

FIG. 3G depicts the sub-dial plate 7 at a time point at which the remaining time is counted down to 0 minute, 8.7 seconds and the countdown has stopped.

At this time, the retrograde hand 21*c* indicates the position "9" of the sub-dial plate 7. The minute display element 41M turns off all the elements. Herein, when the user performs the start operation, the electronic timepiece shifts to the state shown in FIG. 3F.

Figure 3H:
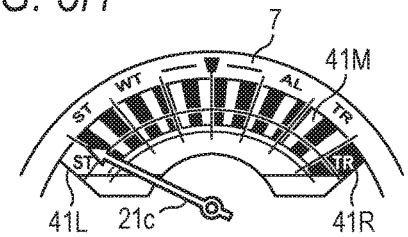

FIG. 3H depicts a first state of the sub-dial plate 7 at a time point that time is up At this time, the retrograde hand 21*c* indicates a position "0" of the sub-dial plate 7. The minute display element 41M turns on the elements of 0 minute to 2 minutes, turns off the elements of 3 minutes to 5 minutes and repeats the lighting and the lights-out, thereby configuring a 10-stripe pattern.

Figure 3I:
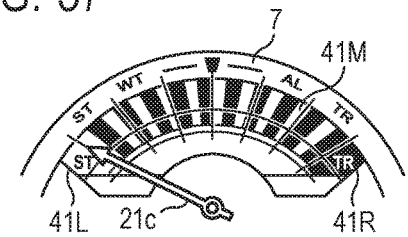

FIG. 3I depicts a second state of the sub-dial plate 7 at a time point that time is up At this time, the retrograde hand 21*c* indicates the position "0" of the sub-dial plate 7. The minute display element 41M turns off the elements of 0 minute to 2 minutes, turns on the elements of 3 minutes to 5 minutes and repeats the lighting and the lights-out, thereby configuring a 10-stripe pattern. In the stripe pattern of the minute display element 41M shown in FIG. 3I, the elements turned on and turned off in the minute display element 41M of FIG. 3H are turned off and turned on, respectively.

The first state of FIG. 3H and the second state of FIG. 3I are alternately repeated with a predetermined interval, so that the display of the minute display element 41M has an entertainment characteristic, which is pleasure to user's eyes.

FIGS. 4A to 4E depict movement of the retrograde hand 21*c* in the timer mode.

Figure 4A:
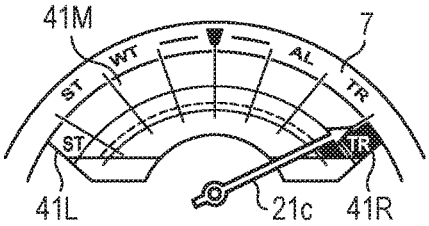
FIGS. 4A to 4E depict movement of a retrograde hand in the timer mode.

FIG. 4A depicts the retrograde hand 21*c* between 0 second and 59.6 seconds per minute. At this time, the retrograde hand 21*c* indicates the position "60" of the sub-dial plate 7.

Figure 4B:
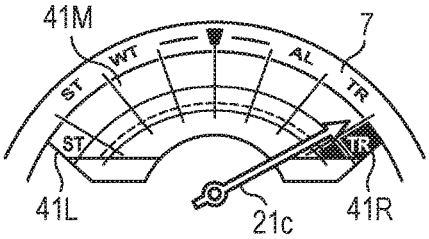

FIG. 4B depicts the retrograde hand 21*c* between 59.5 seconds and 59.1 seconds per minute. At this time, the retrograde hand 21*c* indicates a position "59.5" of the sub-dial plate 7. Thereafter, as time elapses, the remaining time of the timer is counted down, and the retrograde hand 21*c* gently rotates by 1 per second in the counterclockwise direction.

Figure 4C:
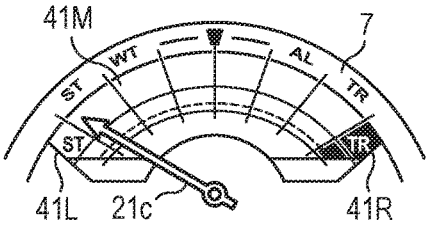

FIG. 4C depicts the retrograde hand 21*c* between 0 second and 0.6 second per minute.

At this time, the retrograde hand 21*c* indicates a position "1" of the sub-dial plate 7.

Figure 4D:
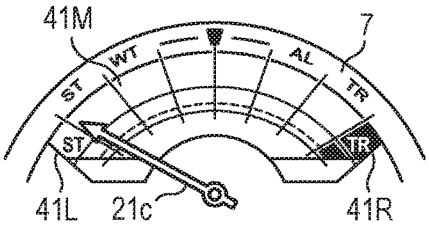

FIG. 4D depicts the retrograde hand 21*c* between 0.5 second and 0.1 second per minute. At this time, the retrograde hand 21*c* indicates a position "0.5" of the sub-dial plate 7. Thereafter, when the minute decreases, the retrograde hand 21*c* is fast forwarded in the clockwise direction, thereby indicating the position "60" in a moment. This is referred to as the flyback of the retrograde hand 21*c*. After the flyback in one second, the retrograde hand 21*c* gently moves in the counterclockwise direction for about 1 minute, and alternately repeats the hand-moving and the flyback. By the movement of the retrograde hand 21*c*, the timer display has an entertainment characteristic, which is pleasure to user's eyes. Also, since the retrograde hand 21*c* is configured to fly back and to fast forward at 0.5 second per minute and to indicate the position "60" at 0 second per minute, it can express an operation pattern without being late for the decrease of minute.

Figure 4E:
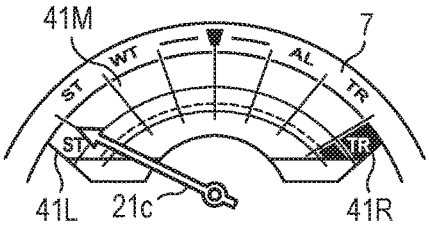

FIG. 4E depicts the retrograde hand 21*c* at a time point at which time is up. At this time, the retrograde hand 21*c* indicates a position "0.0" of the sub-dial plate 7.

Figure 5:
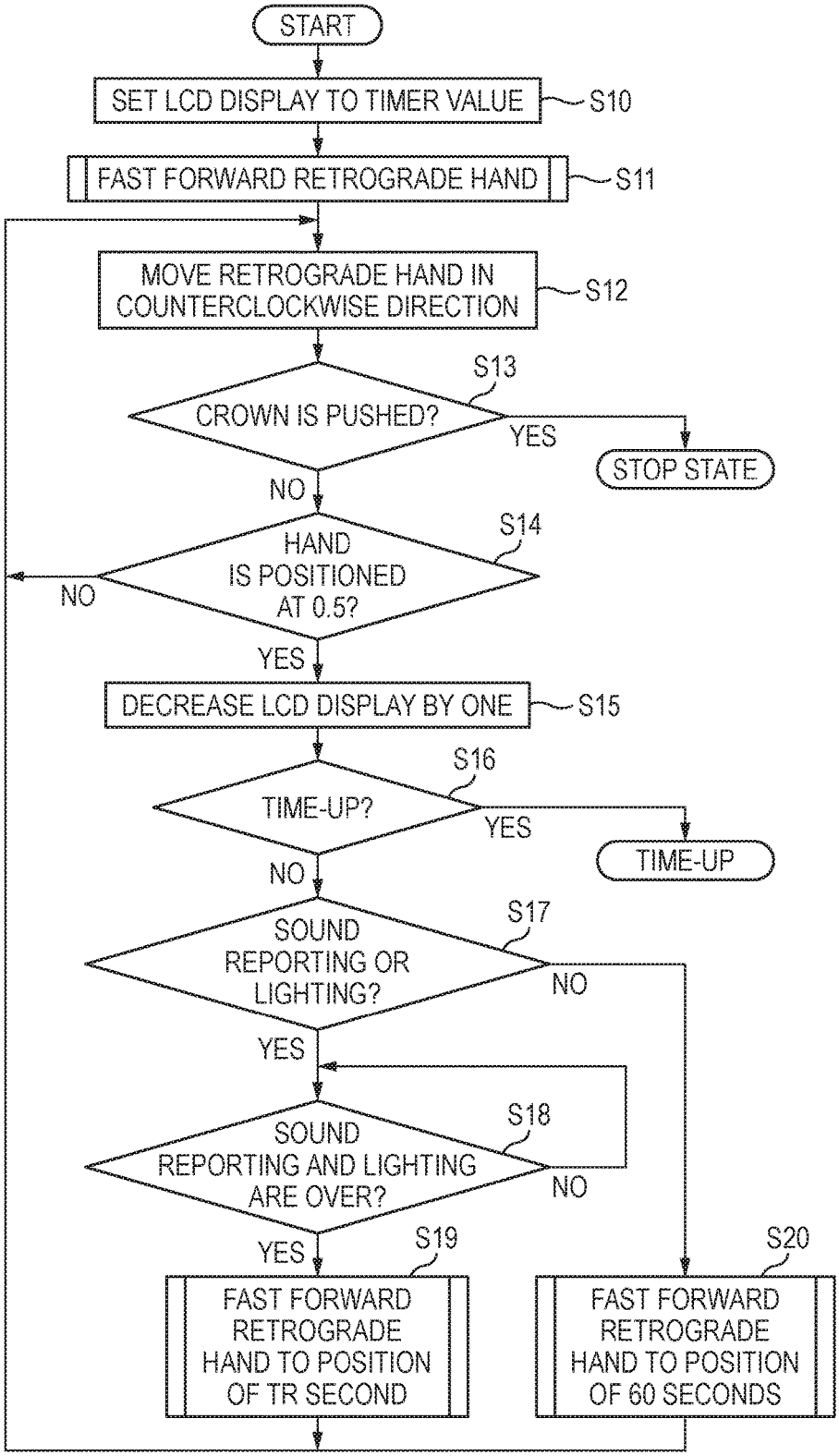
FIG. 5 is a flowchart depicting hand-moving processing of the retrograde hand in the timer mode.

FIG. 5 is a flowchart depicting hand-moving processing of the retrograde hand 21*c* in the timer mode.

Due to a battery capacity, it is not possible to simultaneously perform the sound reporting of the buzzer 44 or the lighting of the light 45 and the flyback (fast forwarding) of the retrograde hand 21*c*. Therefore, it is necessary to perform the operations while making both timings thereof different from each other. Specifically, it is preferably to put a priority on the sound reporting of the buzzer 44 or the lighting of the light 45 and to fast forward the retrograde hand 21*c* in conformity to the second information of the remaining time of the timer upon the ending of the lighting and upon the ending of the sound reporting. The below is a flowchart for implementing the corresponding operation.

When starting the countdown of the timer, the CPU 31 sets the minute display element 41M of the LCD 41 on the basis of the minute information of the set time of the timer (step S10) and fast forwards the retrograde hand 21*c* so as to indicate the second information of the set time of the timer (step S11). Specifically, when the set time of the timer is 10 minutes, 0 second, the minute display element 41M turns on the elements of 0 minute to 9 minutes and the retrograde hand 21*c* indicates the position "60", as shown in FIG. 3A.

In the meantime, the fast forwarding of the retrograde hand 21*c* by the CPU 31 is performed by calling hour hand and minute hand fast-forwarding check processing (refer to FIG. 6 to be described later).

Then, as time elapses, the CPU 31 moves the retrograde hand 21*c* in the counterclockwise direction (step S12) and determines whether the crown 55 is pushed (step S13). When it is determined that the crown 55 is pushed (step S13→Yes), the CPU 31 stops the retrograde hand 21*c* and shifts to a stop state.

The CPU 31 determines whether the retrograde hand 21*c* indicates the position "0.5 second" (step S14). When it is determined that the retrograde hand 21*c* does not indicate the position "0.5 second" (step S14→No), the CPU 31 returns to step S12 and moves the retrograde hand 21*c*. When it is determined that the retrograde hand 21*c* indicates the position "0.5 second" (step S14→Yes), the CPU 31 turns off one element of the minute display element 41M, thereby decreasing the minute display (step S15).

Then, the CPU 31 determines whether time is up (step S16). When it is determined that time is up, the CPU shifts to a time-up state.

Also, the CPU 31 determines whether the buzzer 44 reports a sound or whether the light 45 is turned on (step S17). When it is determined that any of the sound reporting and the lighting is not made, the CPU 31 fast forwards the retrograde hand 21*c* to the position "60" (step S20). Then, the CPU 31 returns to step S12 and repeats the hand-moving of the retrograde hand 21*c*.

When it is determined that the sound is being reported or the light is turned on, the CPU 31 stands by until the sound reporting or the lighting is over (step S18), and fast forwards the retrograde hand 21*c* to the position of the second information of the remaining time of the timer (step S19). Then, the CPU 31 returns to step S12, and repeats the hand-moving of the retrograde hand 21*c*.

Figure 6:
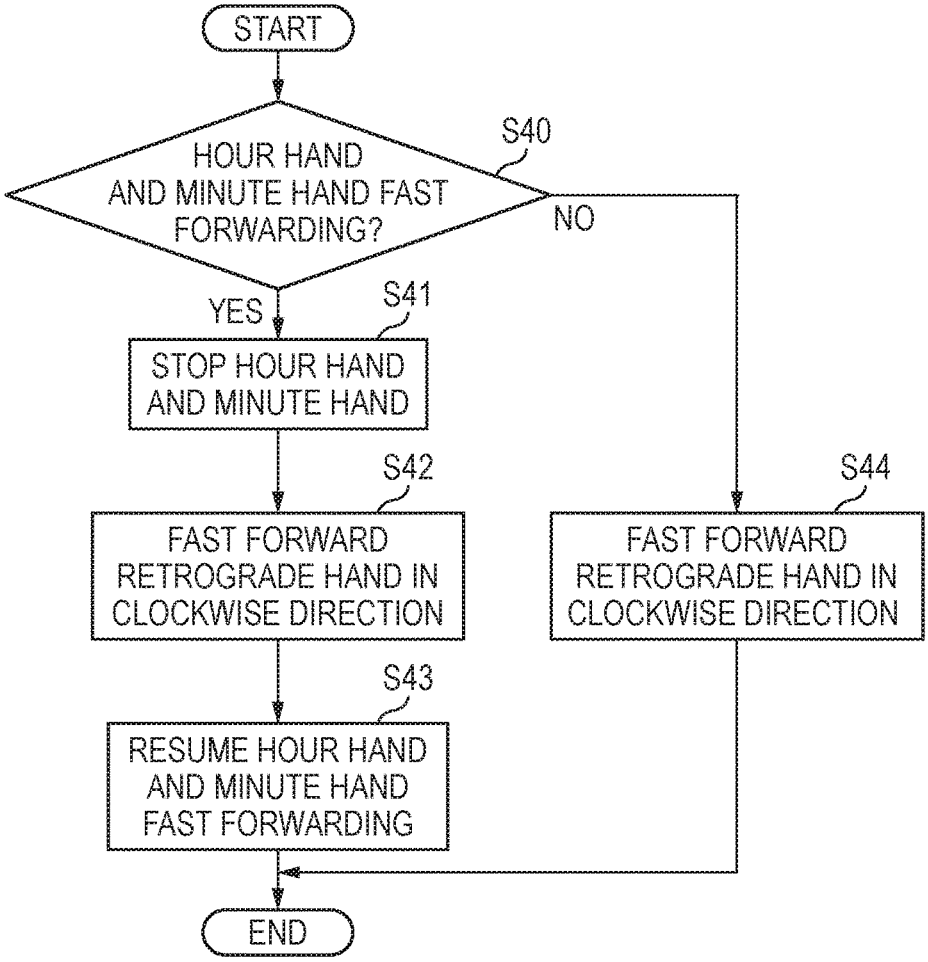
FIG. 6 is a flowchart depicting hour hand and minute hand fast-forwarding check processing.

FIG. 6 is a flowchart depicting hour hand and minute hand fast-forwarding check processing.

Due to the battery capacity, it is not possible to simultaneously perform the fast forwarding of the hour hand 21*a* and the minute hand 21*b* and the flyback (fast forwarding) of the retrograde hand 21*c*. Therefore, it is necessary to perform the operations while making both timings thereof different from each other. Specifically, it is preferably to put a priority on the flyback of the retrograde hand 21*c* and to fast forward the hour hand 21*a* and the minute hand 21*b* upon the ending of the flyback. The below is a flowchart for implementing the corresponding operation.

When it is determined that the hour hand 21*a* and the minute hand 21*b* are not under fast-forwarding (step S40→No), the CPU 31 fast forwards the retrograde hand 21*c* in the clockwise direction (step S44), and ends the processing of FIG. 6.

When it is determined that the hour hand 21*a* and the minute hand 21*b* are under fast-forwarding (step S40→Yes), the CPU 31 stops the hour hand 21*a* and the minute hand 21*b* (step S41) and fast forwards the retrograde hand 21*c* in the clockwise direction (step S42). Then, the CPU 31 resumes the fast-forwarding of the hour hand 21*a* and the minute hand 21*b* (step S43), and ends the processing of FIG. 6.

Operations in Stop Watch Mode

The stop watch mode is a mode in which elapse time of a specific event is to be measured. In the stop watch mode, elapse time from occurrence of an event is counted up and displayed. The elapse time of the stop watch is displayed by a combination of the second information (first time information) and the minute information (second time information), which is a set of the second information.

In the stop watch mode, the movement of the retrograde hand 21*c* is opposite to the movement in the timer mode. In the exemplary embodiment, since the stepping motor 23*c* is a high-torque motor having a plurality of coils, it is possible to reciprocally move the retrograde hand 21*c* in a fan shape at an equal speed in the counterclockwise direction and in the clockwise direction. Therefore, the electronic timepiece 1 of the exemplary embodiment can implement both the movement in the timer mode shown in FIGS. 4A to 4E and the movement in the stop watch mode shown in FIGS. 9A to 9D.

Figure 7A:
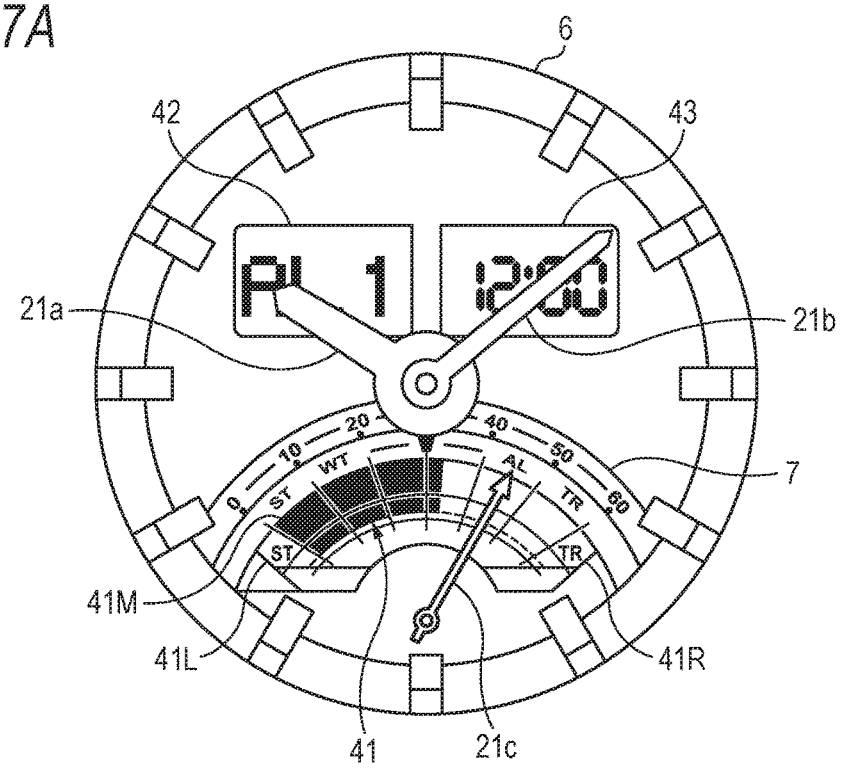
FIGS. 7A and 7B depict shift to a stop watch mode.
Figure 7B:
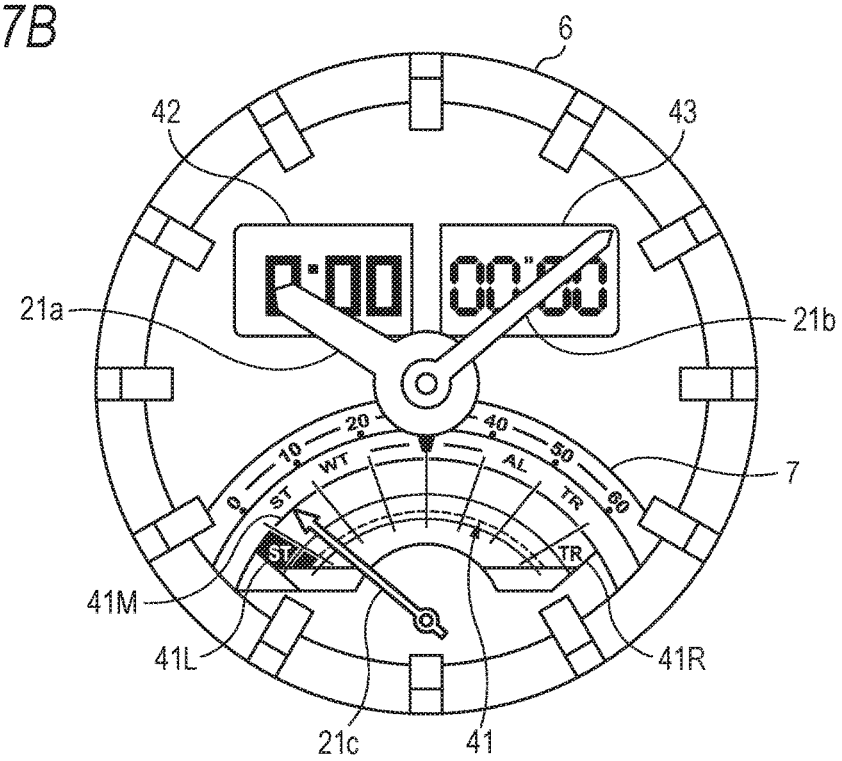

FIGS. 7A and 7B depict shifts to the respective modes.

FIG. 7A is an outline view of the electronic timepiece 1 in the alarm mode.

In the alarm mode, the retrograde hand 21*c* continues to indicate the letter "AL" of the sub-dial plate 7, thereby indicating the alarm mode. The LCD 42 displays an alarm number of a setting target. Herein, the LCD 42 displays the letter "AL1", thereby indicating that a first alarm is set. The LCD 43 displays the alarm time. Herein, "12:00" is displayed, which indicates that "12 o'clock, 0 minute" is set as the first alarm. When a predetermined operation is performed in the alarm mode or in the basic timepiece mode of FIG. 2A, the mode shifts to the stop watch mode of FIG. 7B.

FIG. 7B is an outline view of the electronic timepiece 1 when it shifts to the stop watch mode.

Figure 8A:
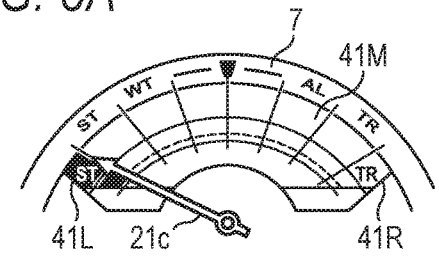
FIGS. 8A to 8I illustrate operations in the stop watch mode.

When the user pushes the switch 53 in the alarm mode, the electronic timepiece 1 shifts to the stop watch mode. When the electronic timepiece 1 shifts to the stop watch mode, the retrograde hand 21*c* indicates the letter "ST" for a predetermined time, so that a display of FIG. 8A is made, which will be described later. The LCD 41 turns on the ST display element 41L of the left end, thereby indicating the shift to the stop watch mode. The LCD 42 displays an hour and a minute of the measured value of the stop watch by integers, and the LCD 43 displays the second of the measured value of the stop watch and the number of decimal places of the second by numbers.

FIGS. 8A to 8I illustrate operations in the stop watch mode. In the stop watch mode, the ST display element 41L at the left end of the LCD 41 is turned on to indicate the letter "ST", and the TR display element 41R is turned off.

FIG. 8A depicts the sub-dial plate 7 at a starting time point 0 minute, 0.0 second of the count-up.

At this time, the retrograde hand 21*c* indicates the position "0" of the sub-dial plate 7. The minute display element 41M positioned at a central part of the LCD 41 turns off all the elements of 0 minute to 60 minutes. In this way, when the CPU 31 does the count-up from n minute, 0.0 second (n: natural number), it controls so that the retrograde hand 21*c* indicates the position "0", contrary to the countdown. Thereby, it is possible to suppress the flyback at the starting time point of the count-up.

Figure 8B:
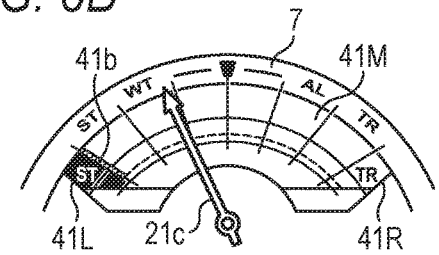

FIG. 8B depicts the sub-dial plate 7 at a time point at which the count-up is done to 0 minute, 18.76 seconds.

At this time, the retrograde hand 21*c* indicates a position "18.5" of the sub-dial plate 7. The minute display element 41M blinks the element of 0 minute, and turns off the elements of 1 minute to 60 minutes. In FIG. 8B, the element of 0 minute being blinked is shown as the display element 41*b*. A blinking period is a few Hz. By the blinking of the display element 41*b*, it is possible to indicate that the stop watch is operating. Herein, when the user performs a stop operation, the electronic timepiece shifts to a state shown in FIG. 8C.

Figure 8C:
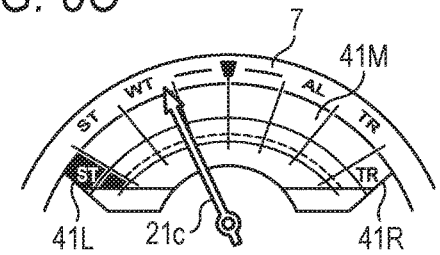

FIG. 8C depicts the sub-dial plate 7 at a time point at which the count-up is done to 0 minute, 18.76 seconds and has stopped.

At this time, the retrograde hand 21*c* indicates the position "18.5" of the sub-dial plate 7. The minute display element 41M turns off all the elements of 0 minute to 60 minutes. Herein, when the user performs a start operation, the electronic timepiece shifts to the state shown in FIG. 8B.

Figure 8D:
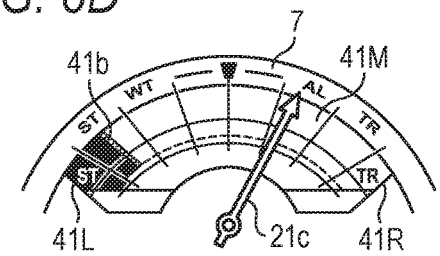

FIG. 8D depicts the sub-dial plate 7 at a time point at which the count-up is done to 5 minutes, 42.56 seconds.

At this time, the retrograde hand 21*c* indicates a position "42.5" of the sub-dial plate 7. The minute display element 41M turns on the elements of 0 minute to 5 minutes, blinks the element of 6 minutes, and turns off the elements of 7 minutes to 60 minutes. In FIG. 8D, the element of 6 minutes being blinked is shown as the display element 41*b*. A blinking period is a few Hz. By the blinking of the display element 41*b*, it is possible to indicate that the stop watch is operating. Herein, when the user performs the stop operation, the electronic timepiece shifts to a state shown in FIG. 8E.

Figure 8E:
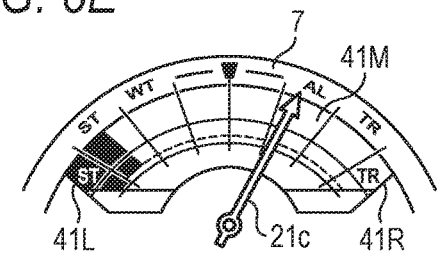

FIG. 8E depicts the sub-dial plate 7 at a time point at which the count-up is done to 5 minutes, 42.56 seconds and has stopped.

At this time, the retrograde hand 21*c* indicates a position "42.5" of the sub-dial plate 7. The minute display element 41M turns on the elements of 0 minute to 5 minutes, and turns off the elements of 6 minutes to 60 minutes. Herein, when the user performs the start operation, the electronic timepiece shifts to the state shown in FIG. 8D.

Figure 8F:
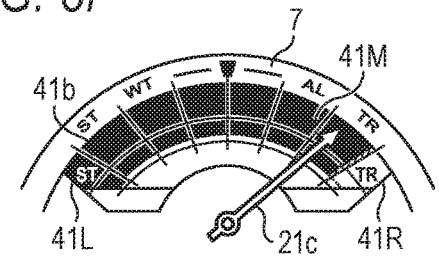

FIG. 8F depicts the sub-dial plate 7 at a time point at which the count-up is done to 59 minutes, 53.42 seconds.

At this time, the retrograde hand 21*c* indicates a position "53" of the sub-dial plate 7. The minute display element 41M turns on the elements of 0 minute to 59 minutes, and blinks the element of 60 minutes. In FIG. 8F, the element of 60 minutes being blinked is shown as the display element 41*b*. A blinking period is a few Hz. By the blinking of the display element 41*b*, it is possible to indicate that the stop watch is operating. Herein, when the user performs the stop operation, the electronic timepiece shifts to a state shown in FIG. 8G.

Figure 8G:
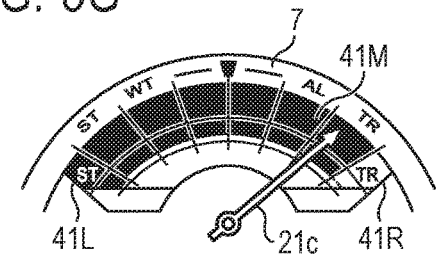

FIG. 8G depicts the sub-dial plate 7 at a time point at which the count-up is done to 59 minutes, 53.42 seconds and has stopped.

At this time, the retrograde hand 21*c* indicates the position "53" of the sub-dial plate 7. The minute display element 41M turns on the elements of 0 minute to 59 minutes and turns off the element of 60 minutes. Herein, when the user performs the start operation, the electronic timepiece shifts to the state shown in FIG. 8F.

Figure 8H:
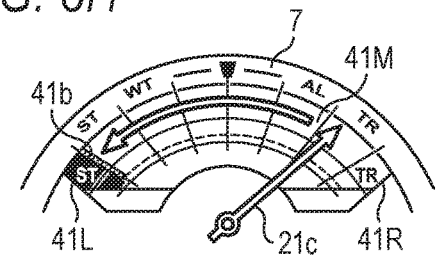

FIG. 8H depicts the sub-dial plate 7 after one hour elapses.

At this time, the retrograde hand 21*c* indicates a position "59.5" of the sub-dial plate 7 and then flies back to the position "0". Thereby, the movement of the retrograde hand 21*c* has an entertainment characteristic, which is pleasure to user's eyes. The minute display element 41M blinks the element of 0 minute and turns off the elements of 1 minute to 60 minutes. By the blinking of the display element 41*b*, it is possible to indicate that the stop watch is operating. When the retrograde hand 21*c* flies back to the position "0", the electronic timepiece shifts to a state shown in FIG. 8I.

Figure 8I:
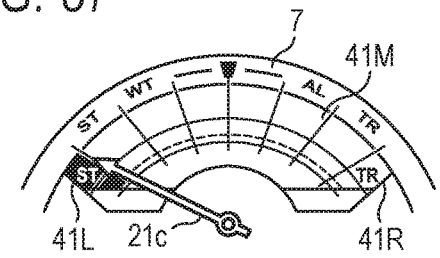

FIG. 8I depicts the sub-dial plate 7 after one hour elapses.

At this time, the retrograde hand 21*c* indicates the position "0" of the sub-dial plate 7. The minute display element 41M turns off all the elements of 0 minute to 60 minutes. Thereby, the electronic timepiece 1 expresses that the stop watch has stopped.

A split means progression elapse time from start of the stop watch to any time point. During the split of the electronic timepiece 1, both the retrograde hand 21*c* and the minute display element 41M display split time. That is, the retrograde hand 21*c* stops at a second of the split time, and the minute display element 41M turns on the elements of 0 minute to (minute of split time—1) minutes, and blinks the element of the minute of the split time.

FIGS. 9A to 9D depict the movement of the retrograde hand 21*c* in the stop watch mode.

Figure 9A:
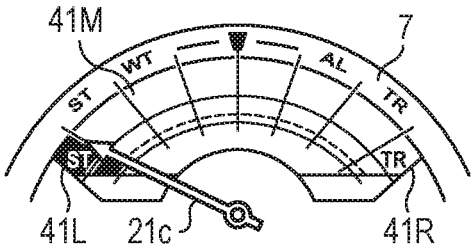
FIGS. 9A to 9D depict movement of the retrograde hand in the stop watch mode.

FIG. 9A depicts the retrograde hand 21*c* from 0 second to 0.4 second per minute. At this time, the retrograde hand 21*c* indicates 0.0.

Figure 9B:
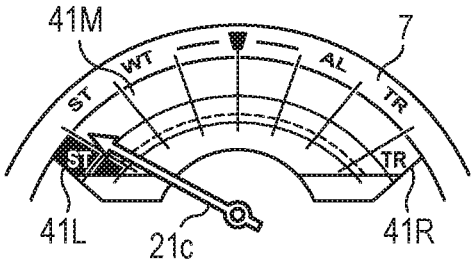

FIG. 9B depicts the retrograde hand 21*c* from 0.5 second to 0.9 second per minute. At this time, the retrograde hand 21*c* indicates a position "0.5" of the sub-dial plate 7. Thereafter, as time elapses, the stop watch counts up, and the retrograde hand 21*c* gently rotates by 1 per second in the clockwise direction.

Figure 9C:
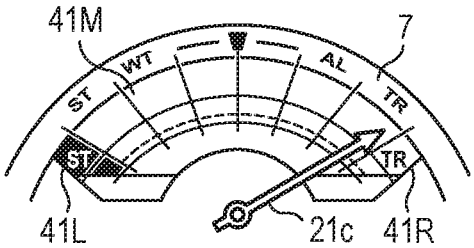

FIG. 9C depicts the retrograde hand 21*c* from 59.0 seconds to 59.4 seconds per minute.

At this time, the retrograde hand 21*c* indicates a position "59" of the sub-dial plate 7.

Figure 9D:
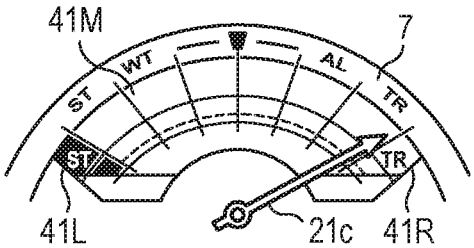

FIG. 9D depicts the retrograde hand 21*c* from 59.5 seconds to 59.9 seconds per minute. At this time, the retrograde hand 21*c* indicates a position "59.5" of the sub-dial plate 7. Thereafter, when the minute increases, the retrograde hand 21*c* is fast rewound in the counterclockwise direction and immediately indicates 0 second. This is referred to as the flyback of the retrograde hand 21*c*. After the flyback in one second, the retrograde hand 21*c* gently moves in the clockwise direction for about 1 minute, and alternately repeats the hand-moving and the flyback. By the movement of the retrograde hand 21*c*, the stopwatch display has an entertainment characteristic, which is pleasure to user's eyes. Also, since the retrograde hand 21*c* is configured to fly back and to be fast rewound at 59.5 second per minute and to indicate the position "0" at 0 second per minute, it can express an operation pattern without being late for the increase of minute.

Figure 10:
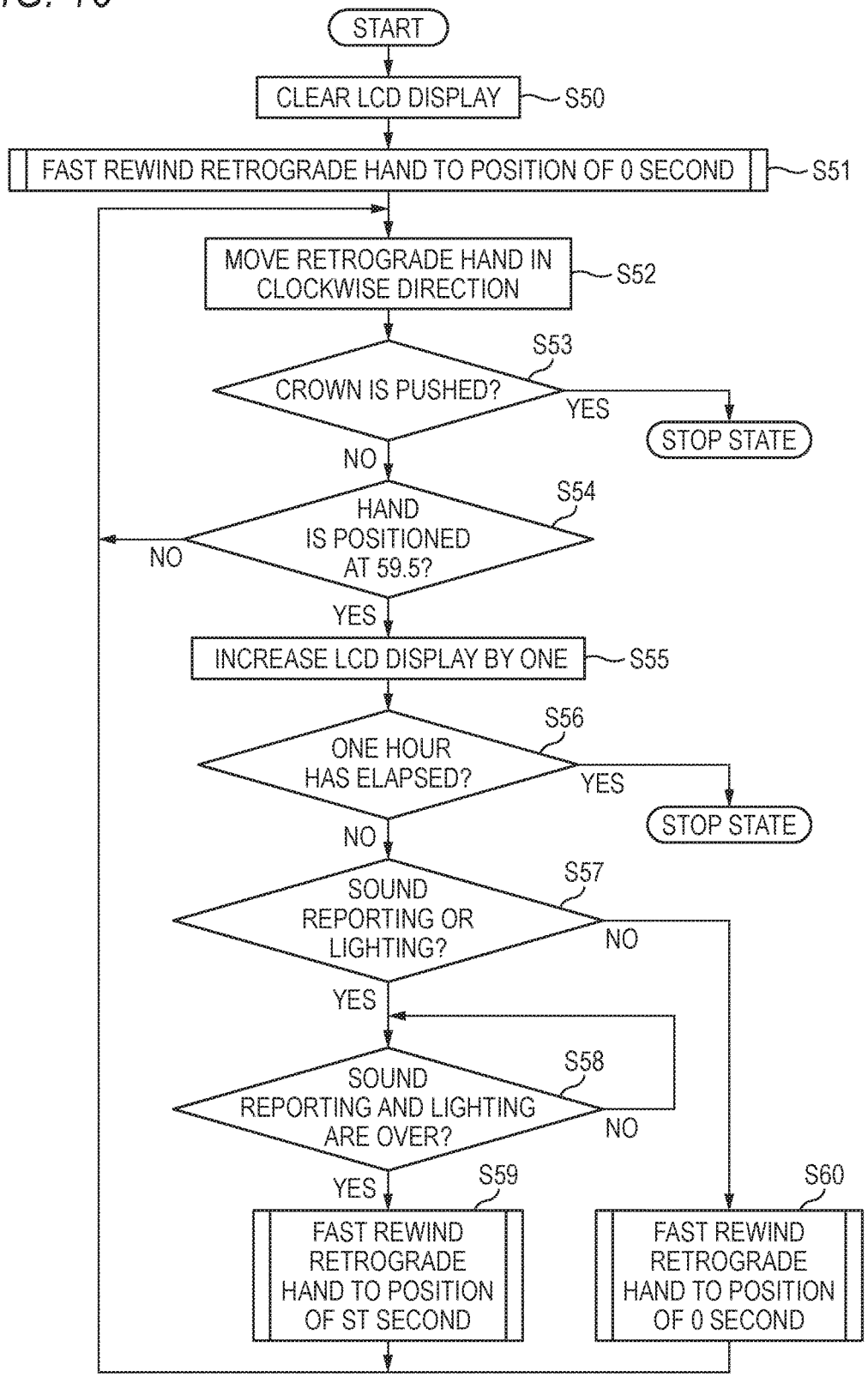
FIG. 10 is a flowchart depicting hand-moving processing of the retrograde hand in the stop watch mode.

FIG. 10 is a flowchart depicting hand-moving processing of the retrograde hand 21*c* in the stop watch mode.

Due to the battery capacity, it is not possible to simultaneously perform the sound reporting of the buzzer 44 or the lighting of the light 45 and the flyback (fast rewinding) of the retrograde hand 21*c*. Therefore, it is necessary to perform the operations while making both timings thereof different from each other. Specifically, it is preferably to put a priority on the sound reporting of the buzzer 44 and the lighting of the light 45 and to fast rewind the retrograde hand 21*c* in conformity to the second information of the elapse time of the stop watch upon the ending of the lighting and upon the ending of the sound reporting. The below is a flowchart for implementing the corresponding operation.

When starting the measurement of the stop watch, the CPU 31 clears the minute display element 41M of the LCD 41 to display 0 minute (step S50) and fast rewinds the retrograde hand 21*c* to indicate the position "0" (step S51). In the meantime, the fast rewinding of the retrograde hand 21*c* by the CPU 31 is performed by calling hour hand and minute hand fast-forwarding check processing (refer to FIG. 11 to be described later).

Then, as time elapses, the CPU 31 moves the retrograde hand 21*c* in the clockwise direction (step S52) and determines whether the crown 55 is pushed (step S53). When it is determined that the crown 55 is pushed (step S53→Yes), the CPU 31 stops the retrograde hand 21*c* and shifts to a stop state.

When it is determined that the crown 55 is not pushed (step S53→No), the CPU 31 determines whether the retrograde hand 21*c* indicates the position "59.5 second" (step S54). When it is determined that the retrograde hand 21*c* does not indicate the position "59.5 second" (step S54→No), the CPU 31 returns to step S52 and moves the retrograde hand 21*c*. When it is determined that the retrograde hand 21*c* indicates the position "59.5 second" (step S54→Yes), the CPU 31 newly turns on one element of the minute display element 41M, thereby increasing the minute display (step S55).

Then, the CPU 31 determines whether one hour has elapsed (step S56). When it is determined that one hour has elapsed, the CPU shifts to the stop state.

Also, when it is determined that one hour has not elapsed (step S56→No), the CPU 31 determines whether the buzzer 44 reports a sound or whether the light 45 is turned on (step S57). When it is determined that any of the sound reporting and the lighting is not made, the CPU 31 fast rewinds the retrograde hand 21*c* to the position "0" (step S20). Then, the CPU 31 returns to step S52 and repeats the hand-moving of the retrograde hand 21*c*.

When it is determined that the sound is being reported or the light is turned on (step S57→Yes), the CPU 31 stands by until the sound reporting or the lighting is over (step S58), and fast rewinds the retrograde hand 21*c* to the position of the second information of the elapse time of the stop watch (step S59). Then, the CPU 31 returns to step S52, and repeats the hand-moving of the retrograde hand 21*c*.

Figure 11:
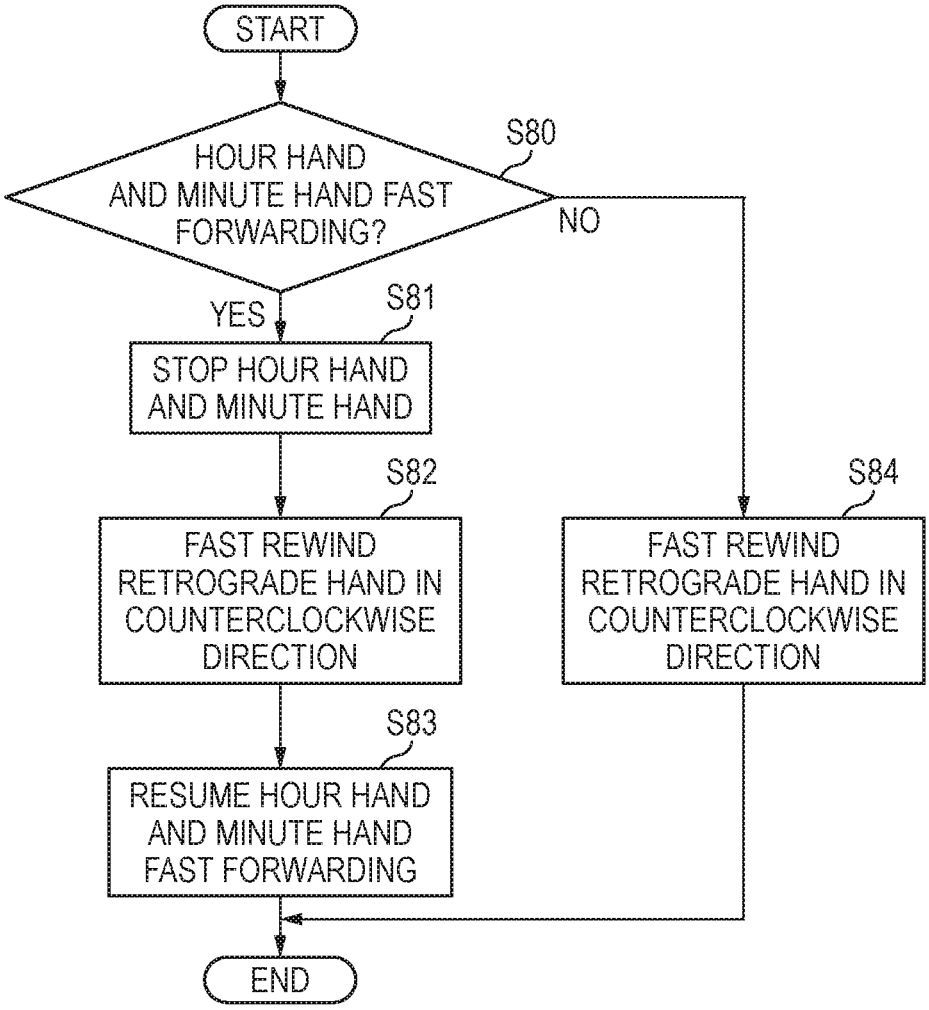
FIG. 11 is a flowchart depicting hour hand and minute hand fast-forwarding check processing.

FIG. 11 is a flowchart depicting hour hand and minute hand fast-forwarding check processing.

Due to the battery capacity, it is not possible to simultaneously perform the fast forwarding of the hour hand 21*a* and the minute hand 21*b* and the flyback (fast rewinding) of the retrograde hand 21*c*. Therefore, it is necessary to perform the operations while making both timings thereof different from each other. Specifically, it is preferably to put a priority on the flyback of the retrograde hand 21*c* and to fast forward the hour hand 21*a* and the minute hand 21*b* upon the ending of the flyback. The below is a flowchart for implementing the corresponding operation.

When it is determined that the hour hand 21*a* and the minute hand 21*b* are not under fast-forwarding (step S80→No), the CPU 31 fast rewinds the retrograde hand 21*c* in the counterclockwise direction (step S84), and ends the processing of FIG. 11.

When it is determined that the hour hand 21*a* and the minute hand 21*b* are under fast-forwarding (step S90→Yes), the CPU 31 stops the hour hand 21*a* and the minute hand 21*b* (step S81) and fast rewinds the retrograde hand 21*c* in the counterclockwise direction (step S82). Then, the CPU 31 resumes the fast-forwarding of the hour hand 21*a* and the minute hand 21*b* (step S83), and ends the processing of FIG. 11.

Modified Embodiments

The invention is not limited to the above exemplary embodiment and can be changed without departing from the gist of the invention. For example, following (a) to (e) embodiments can be exemplified.

(a) The retrograde hand 21*c* and the LCD 41 are not limited to the electronic timepiece 1 and can be applied to any hand device.

(b) The display information by the retrograde hand 21*c* and the LCD 41 is not limited to the remaining time of the timer and the elapse time of the stop watch, may be any information such as current time and world time and are not particularly limited.

(c) The position of the sub-dial plate 7 is not limited to the 6-oclock direction of the main dial plate 6 and may be a 3-oclock direction, a 9-oclock direction, a 0-oclock direction or the like. Also, the sub-dial plate 7 is not limited to one and a plurality of sub-dial plates may be arranged on the main dial plate 6.

(d) The remaining time of the timer and the elapse time of the stop watch are not limited to the combination of the second information and the minute information, and may be a combination of any time unit and a separate time unit, which is a set of any time units, such as a combination of the second information and information of a 100-second unit and a combination of the minute information and hour information.

(e) The operation mode indicated by the retrograde hand 21*c* is not limited to the stop watch mode, the timer mode, the alarm mode and the world time mode and may be any mode.

The invention claimed is:

1. An electronic timepiece comprising:

a hand configured to reciprocally move in a fan shape in a counterclockwise direction and in a clockwise direction;

a driving unit configured to drive the hand; and a display unit, at least a part of which is arranged below the hand and within a reciprocal movement range of the hand, wherein the electronic timepiece is configured to display predetermined information by a combination of display by the display unit and a position of the hand, wherein the electronic timepiece is configured to indicate first time information by a position of the hand and to indicate second time information by the display unit, wherein the first time information indicates time in a first unit of time, and the second time information indicates time in a second unit of time which longer than the first unit of time, wherein the electronic timepiece has a stopwatch mode to measure an elapsed time which is indicated by the first time information and the second time information, and wherein, in the stopwatch mode:

the driving unit is configured to drive the hand in the clockwise direction from a stopwatch mode origin position as the elapsed time increases to show increments of the elapsed time in the first unit of time;

the display unit is configured to show increments of the elapsed time in the second unit of time; and when the elapsed time approaches a next increment of the second unit of time, the driving unit is configured to drive the hand in the counterclockwise direction to return the hand to the stopwatch mode origin position.

2. The electronic timepiece according to claim 1, wherein the display unit comprises a display area, which indicates stop watch mode, at a left side.

3. The electronic timepiece according to claim 1, wherein the electronic timepiece has a timer mode to count down a set time, the countdown being indicated by the first time information and the second time information, and wherein, in the timer mode:

the driving unit is configured to drive the hand in the counterclockwise direction from a timer mode origin position as the set time counts down to show increments of the countdown in the first unit of time; and the display unit is configured to show increments of the countdown in the second unit of time.

4. The electronic timepiece according to claim 3, wherein in the timer mode, when the countdown approaches a next increment of the second unit of time, the driving unit is configured to drive the hand in the clockwise direction to return the hand to the timer mode origin position.

5. The electronic timepiece according to claim 4, wherein the display unit comprises a display area, which indicates the timer mode, at a right side.

6. The electronic timepiece according to claim 5, wherein the display unit is configured to blink when the set time has elapsed.

7. The electronic timepiece according to claim 4, wherein the display unit is configured to blink when the set time has elapsed.

8. The electronic timepiece according to claim 3, wherein the display unit comprises a display area, which indicates the timer mode, at a right side.

9. The electronic timepiece according to claim 8, wherein the display unit is configured to blink when the set time has elapsed.

10. The electronic timepiece according to claim 4, wherein, in the timer mode, the driving unit is configured to drive the hand in the counterclockwise direction at a first speed, and to drive the hand in the clockwise direction at a second speed which is faster than the first speed.

11. The electronic timepiece according to claim 3, wherein the display unit is configured to blink when the set time has elapsed.

12. The electronic timepiece according to claim 3, wherein the driving unit is configured to drive the hand in the clockwise direction in the stopwatch mode at a same speed as the driving unit drives the hand in the counterclockwise direction in the timer mode.

13. The electronic timepiece according to claim 3, wherein, in the timer mode, the display unit is configured to blink a portion of the display unit that indicates a currently-elapsing increment of the second unit of time.

14. The electronic timepiece according to claim 1, wherein the driving unit is operable to drive the hand at a same speed in the clockwise direction as in the counterclockwise direction, and wherein the driving unit is also operable to drive the hand at a different speed in the clockwise direction than in the counterclockwise direction.

15. The electronic timepiece according to claim 1, wherein, in the stopwatch mode, the driving unit is configured to drive the hand in the clockwise direction at a first speed, and to drive the hand in the counterclockwise direction at a second speed which is faster than the first speed.

16. The electronic timepiece according to claim 1, wherein, in the stopwatch mode, the display unit is configured to blink a portion of the display unit that indicates a currently-elapsing increment of the second unit of time.

17. A method of controlling an electronic timepiece to perform a stopwatch function, the electronic timepiece comprising a hand, a driving unit configured to drive the hand, and a display unit, at least a part of the display unit being arranged below the hand and within a movement range of the hand, the electronic timepiece being configured to indicate first time information by a position of the hand and to indicate second time information by the display unit, the first time information indicating time in a first unit of time, the second time information indicating time in a second unit of time which longer than the first unit of time, and the method comprising:

driving the hand in a clockwise direction by the driving unit as an elapsed time increases to show increments of the elapsed time in the first unit of time;

displaying, by the display unit, increments of the elapsed time in the second unit of time; and when the elapsed time approaches a next increment of the second unit of time, driving the hand in a counterclockwise direction by the driving unit to return the hand to an origin position.

18. A method of controlling an electronic timepiece to perform a timer function, the electronic timepiece comprising a hand, a driving unit configured to drive the hand, and a display unit, at least a part of the display unit being arranged below the hand and within a movement range of the hand, the electronic timepiece being configured to indicate first time information by a position of the hand and to indicate second time information by the display unit, the first time information indicating time in a first unit of time, the second time information indicating time in a second unit of time which longer than the first unit of time, and the method comprising:

driving the hand in a counterclockwise direction by the driving unit as a set time to be counted down decreases, to show increments of the countdown in the first unit of time;

displaying, by the display unit, increments of the countdown in the second unit of time; and when the countdown approaches a next increment of the second unit of time, driving the hand in a clockwise direction by the driving unit to return the hand to an origin position.

19. A non-transitory computer-readable recording medium storing a hand driving program that is executable by a processor of an electronic timepiece to control the electronic timepiece to perform a stopwatch function, the electronic timepiece comprising a hand, a driving unit configured to drive the hand, and a display unit, at least a part of the display unit being arranged below the hand and within a movement range of the hand, the electronic timepiece being configured to indicate first time information by a position of the hand and to indicate second time information by the display unit, the first time information indicating time in a first unit of time, the second time information indicating time in a second unit of time which longer than the first unit of time, and the hand driving program being executable by the processor to control the electronic timepiece to perform functions comprising:

driving the hand in a clockwise direction by the driving unit as an elapsed time increases to show increments of the elapsed time in the first unit of time;

displaying, by the display unit, increments of the elapsed time in the second unit of time; and when the elapsed time approaches a next increment of the second unit of time, driving the hand in a counterclockwise direction by the driving unit to return the hand to an origin position.

20. A non-transitory computer-readable recording medium storing a hand driving program that is executable by a processor of an electronic timepiece to control the electronic timepiece to perform a timer function, the electronic timepiece comprising a hand, a driving unit configured to drive the hand, and a display unit, at least a part of the display unit being arranged below the hand and within a movement range of the hand, the electronic timepiece being configured to indicate first time information by a position of the hand and to indicate second time information by the display unit, the first time information indicating time in a first unit of time, the second time information indicating time in a second unit of time which longer than the first unit of time, and the hand driving program being executable by the processor to control the electronic timepiece to perform functions comprising:

driving the hand in a counterclockwise direction by the driving unit as a set time to be counted down decreases, to show increments of the countdown in the first unit of time;

displaying, by the display unit, increments of the countdown in the second unit of time; and when the countdown approaches a next increment of the second unit of time, driving the hand in a clockwise direction by the driving unit to return the hand to an origin Position.

* * * * *